US006109083A

United States Patent [19]

Steinmair

[11] Patent Number: 6,109,083

[45] Date of Patent: Aug. 29, 2000

[54] DEVICE FOR CONTINUOUSLY ROLLING A SHEET-METAL STRIP INTO A PROFILE WITH PROFILE LIMBS OF STRAIGHT CROSS SECTION, IN PARTICULAR FOR PRODUCING LONGITUDINALLY WELDED RECTANGULAR TUBES

[75] Inventor: Karl Steinmair, Schiedlberg, Austria

[73] Assignee: Voest-Alpine Industrieanlaqenbau GmbH, Austria

[21] Appl. No.: 09/245,059

[22] Filed: Feb. 4, 1999

[30] Foreign Application Priority Data

Feb. 26, 1998 [AT] Austria ..... 344/98

[51] Int. Cl.[7] ..... B21D 5/08

[52] U.S. Cl. ..... 72/181; 72/247; 72/248

[58] Field of Search ..... 72/181, 182, 179, 72/247, 248

[56] References Cited

U.S. PATENT DOCUMENTS

| | | | |
|---|---|---|---|
| 1,673,787 | 6/1928 | Frahm | 72/181 |
| 3,336,781 | 8/1967 | Wilson | 72/248 |
| 3,595,056 | 7/1971 | Hutton | 72/181 |
| 4,064,727 | 12/1977 | Amano | 72/179 |
| 4,558,577 | 12/1985 | Trishevsky et al. | 72/12 |
| 4,578,978 | 4/1986 | Onoda | 72/181 |
| 4,947,671 | 8/1990 | Lindstrom | 72/181 |
| 4,969,347 | 11/1990 | Matsuo | 72/247 |
| 5,319,952 | 6/1994 | Cadney | 72/181 |
| 5,423,201 | 6/1995 | Steinmair et al. | 72/225 |
| 5,829,294 | 11/1998 | Bradbury | 72/247 |

FOREIGN PATENT DOCUMENTS

| | | | |
|---|---|---|---|
| 399674 | 6/1995 | Austria . | |
| 202121 | 11/1984 | Japan | 72/181 |
| 83725 | 5/1985 | Japan | 72/181 |

*Primary Examiner*—Daniel C. Crane
*Attorney, Agent, or Firm*—Ostrolenk, Faber, Gerb & Soffen, LLP

[57] ABSTRACT

A description is given of a device for continuously rolling a sheet-metal strip into a profile with profile limbs of straight cross section, in particular for producing longitudinally welded rectangular tubes specifically with the aid of former rolls (13) which are arranged on both sides of a central plane (2) running in the longitudinal direction of the strip and are mounted in a separate frame (11, 12) in each case together with counter-rolls (14) which are aligned perpendicular to the central plane (2) and can be adjusted perpendicular to the central plane (2). In order to create advantageous design conditions, it is proposed that the frames (11, 12) are arranged on each side of the central plane (2) with the associated counter-rolls (14) respectively opposite the neighbouring frames (12, 11) on the opposite side of the central plane (2) in a fashion offset in the longitudinal direction of the strip.

7 Claims, 6 Drawing Sheets

Figure 1:
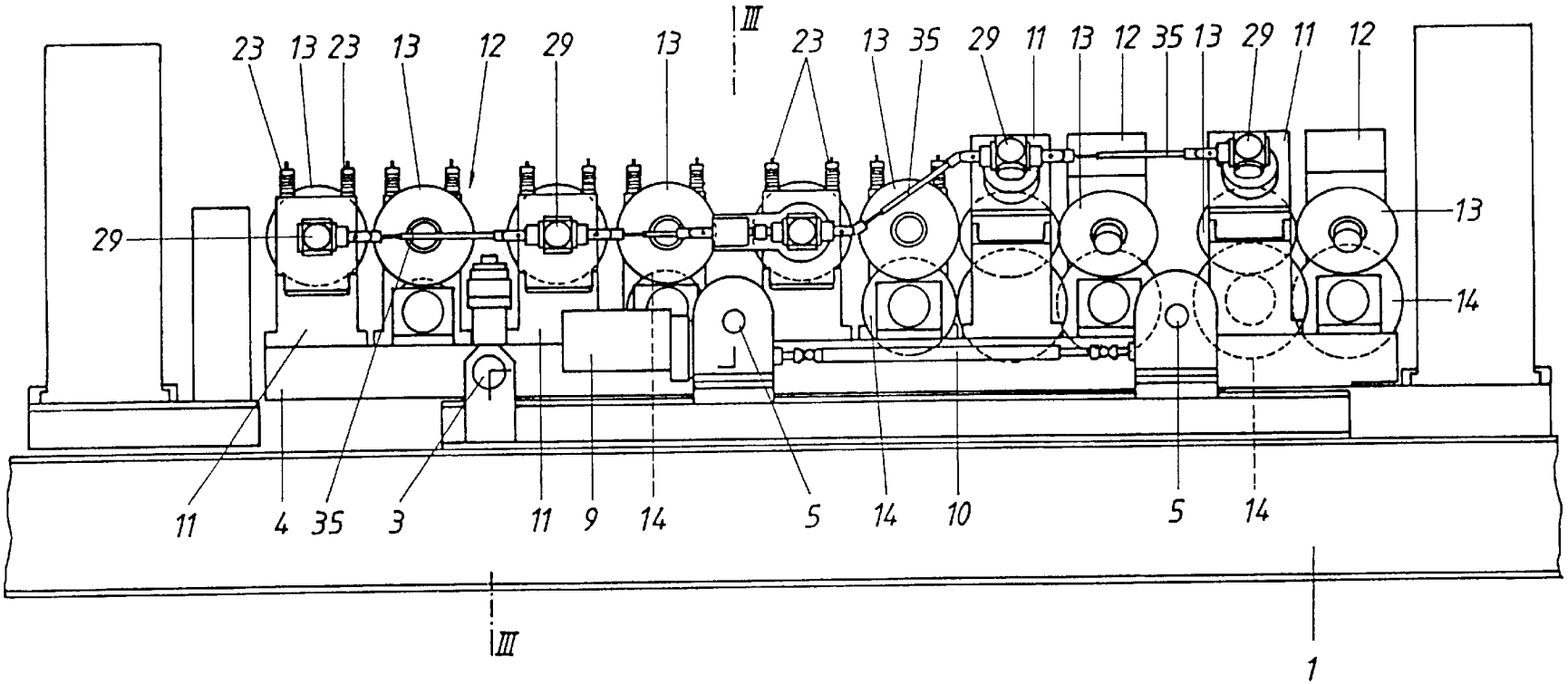

DEVICE FOR CONTINUOUSLY ROLLING A SHEET-METAL STRIP INTO A PROFILE WITH PROFILE LIMBS OF STRAIGHT CROSS SECTION, IN PARTICULAR FOR PRODUCING LONGITUDINALLY WELDED RECTANGULAR TUBES

The invention relates to a device for continuously rolling a sheet-metal strip into a profile with profile limbs of straight cross section, in particular for producing longitudinally welded rectangular tubes, comprising former rolls which are arranged on both sides of a central plane running in the longitudinal direction of the strip and are mounted in a separate frame in each case together with counter-rolls which are aligned perpendicular to the central plane and can be adjusted perpendicular to the central plane.

In order to produce longitudinally welded rectangular tubes, it is known to deform a flat sheet-metal strip with the aid of former and counter-rolls in a symmetrical fashion with respect to a central plane running in the longitudinal direction of the strip, doing so in such a way that that wall of the rectangular tube which is formed by the central band of the metal sheet is situated opposite the tube wall with the weld seam. This tube wall with the weld seam is thus composed of two angular edge webs of the sheet-metal strip which are firstly bent up from the flat sheet-metal strip before the mutually opposite side walls between the wall with the weld seam and the tube wall formed by the central band of the sheet-metal strip have their edges bent up. A disadvantage of known devices for rolling such rectangular tubes is, however, that the former and counter-rolls which cause the symmetrical upward bending of the edges must be adapted to the cross-sectional dimensions of the rectangular tube to be formed, with the result that to produce rectangular tubes with a changed cross-sectional dimension it is necessary to exchange both the former and the counter-rolls. When the edge webs are being bent up, the cylindrical section of the former and counter-rolls which guides the flat part of the sheet-metal strip between these edge webs must have an axial width which corresponds to the tube circumference reduced by the width of the tube wall with the weld seam. The upward blending of the side walls of the later rectangular tube which adjoin the canted edge webs requires cylindrical sections of the former and counter-rolls to have an axial width of the dimension of the width of the tube wall opposite the weld seam, with the result that when the widths of the walls of the rectangular tube are changed it is necessary to reset the rolling device.

The situation is similar when sheet-metal strips of different thickness are used, because, after all, in such a case it is necessary for the roll gap to be adapted to the thickness of the strip not only between the cylindrical sections of the former and counter-rolls but also in the region of the conical sections.

In order to permit simple adaptation to different tube diameters in the case of devices for shaping round tubes into rectangular tubes, it is already known (AT 399 674 B) to mount the former rolls, which are situated opposite one another in pairs, such that they can be displaced axially with respect to one another so that the mutually axially overlapping sections of the former rolls respectively situated opposite one another form the rolling contour, which can therefore be matched to the dimensions of the rectangular tube to be produced, by axially displacing the former rolls situated opposite one another. However, this known device proceeds from an already finished tube, and this rules out the use of such a device for bending up a flat sheet-metal strip in sections.

Finally, for the purpose of rolling profiles of U-shaped cross section whose web connecting the two limbs widens or tapers in a longitudinal section, it is already known (U.S. Pat. No. 4,558,577) to provide separate former and counter-rolls for the profile limbs situated opposite one another, in order to render possible a widening or tapering web between the limbs by adjusting the former and counter-rolls in opposite senses with respect to the longitudinal central plane of the profile. These former and counter-rolls situated opposite one another symmetrically can be mounted on common spindles in a frame, or can be held in frames which are situated opposite one another with respect to the plane of symmetry of the U-profile and can be adjusted in opposite senses relative to one another in order to be able to take account again of the varying limb spacing. Although it is possible to adapt to different widths of web with the aid of this known device, the cylindrical section of the former and counter-rolls has to be reduced at least to half the smallest width of web, and this entails the risk of the end-face edges of these cylindrical sections of the former or counter-rolls rolling into the web and thus damaging the web surface.

It is therefore the object of the invention to configure a device of the type outlined at the beginning for continuously rolling a sheet-metal strip into a profile with profile limbs of straight cross section, in particular for producing longitudinally welded rectangular tubes, doing so with comparatively simple structural means in such a way that it is possible to ensure substantial adaptation to different cross-sectional dimensions of the profile without the need to fear impairment of the surface quality of the profile limbs.

The invention achieves the object set by virtue of the fact that the frames are arranged on each side of the central plane with the associated counter-rolls respectively opposite the neighbouring frames on the opposite side of the central plane in a fashion offset in the longitudinal direction of the strip.

Because of the mutual offsetting of the frames on the opposite sides of the central plane and the asymmetrical deformation, associated therewith, of the sheet-metal strip, it is possible to select the axial width of the cylindrical sections of the former rolls in accordance with the wall widths of the smallest cross-sectional profile for which the device is designed, there being no need, because of the missing opposite former roll, to divide the width of the cylindrical sections of the former rolls. The cylindrical section of the counter-rolls can be selected arbitrarily per se, because the edge of the wall is bent up only at one end. The result is to achieve a far-reaching possibility of adjusting the device to adapt to different profile cross sections without the need to accept risk of damage to the surfaces of the profile limbs. Rather, conditions comparable to the conventional rolling conditions without adjustable former and counter-rolls are created. Similar conditions occur if the former rolls are aligned not parallel to the counter-rolls but at an acute angle thereto, with the result that a conical section of the former rolls operates with a cylindrical section of the counter-rolls in each case.

Since it is the case that because of the limitation of the permissible bending angle the required angles at which the edges are bent up can in general be reached only in steps, a plurality of former rolls are usually provided for bending up the edges of one of the later profile limbs. This means that these former rolls must be adjusted in common with their counter-rolls for the purpose of adaptation to a changed width of profile limb. For this reason, the frames for the former rolls and the associated counter-rolls can be arranged at least in groups on the two sides of the central plane on carriers which can be adjusted transverse to the central plane, separate adjustment of the individual frames thereby being superfluous.

The use of sheet-metal strips of different thickness requires an additional setting of the roll gaps. For this purpose, as regards height the former rolls can be mounted in their frame such that they can be adjusted with respect to the associated counter-rolls. In this connection, particularly advantageous design conditions occur when the former rolls, which can be adjusted as regards height, are mounted eccentrically in a bearing sleeve held such that it can be adjusted rotatably in their frame, with the result that the roll gap can be set by rotating the bearing sleeves. The slight displacement, associated with this height adjustment, of the former rolls in the longitudinal direction of the strip does not influence the deformation operation.

In order to obtain a uniform adjustment of the roll gap in the region both of the cylindrical and of the conical sections of the former and counter-rolls, the former roll is to be displaced with respect to the counter-roll in the direction of the line of angular symmetry of the bending angle which occurs between the cylindrical and conical sections of the former and counter-rolls. This means that the former rolls must be mounted in their frame such that they can be adjusted not only as regards height but also longitudinally in the direction of their axis. If, for this purpose, the bearing sleeves holding the former rolls eccentrically are held in the frame such that they can be adjusted by screws, it is also advantageously possible to ensure a corresponding axial displacement with the height adjustment of the former rolls, and this entails a uniform adjustment of the roll gap both in the cylindrical and in the conical region of the former and counter-rolls when the pitch of the screw adjustment for the bearing sleeves is selected in accordance with the respective bending angle.

Since when use is made of a sheet-metal strip of different thickness all the former rolls must be adjusted with respect to the associated counter-rolls to adapt to the changed thickness of the strip, it is possible for the former rolls to be adjustable in the individual frames at least in groups as regards height and/or in the direction of their axis via a common drive connection, the result being a particularly simple control of the device.

If the former rolls are mounted in a frame part which is pivoted about a swivelling axis, running in he longitudinal direction of the strip, on the frame carrying the counter-roll, it is possible to create advantageous conditions for installing and dismantling the former rolls and the counter-rolls, in particular when the axis of the formers rolls runs at an acute angle with respect to the axis of the associated counter-roll. It is advantageously possible by means of such a mounting of the former rolls for profile limbs whose edges have already been bent up to be gripped from behind, and this enhances the possibility of shaping the profiles to be produced. Moreover, it is possible through such an ability of the frame part holding the former roll to Divot to achieve a simple overload protection when the frame part, holding the former roll, of the frames can be swivelled out of a working position against spring force.

Figure 2:
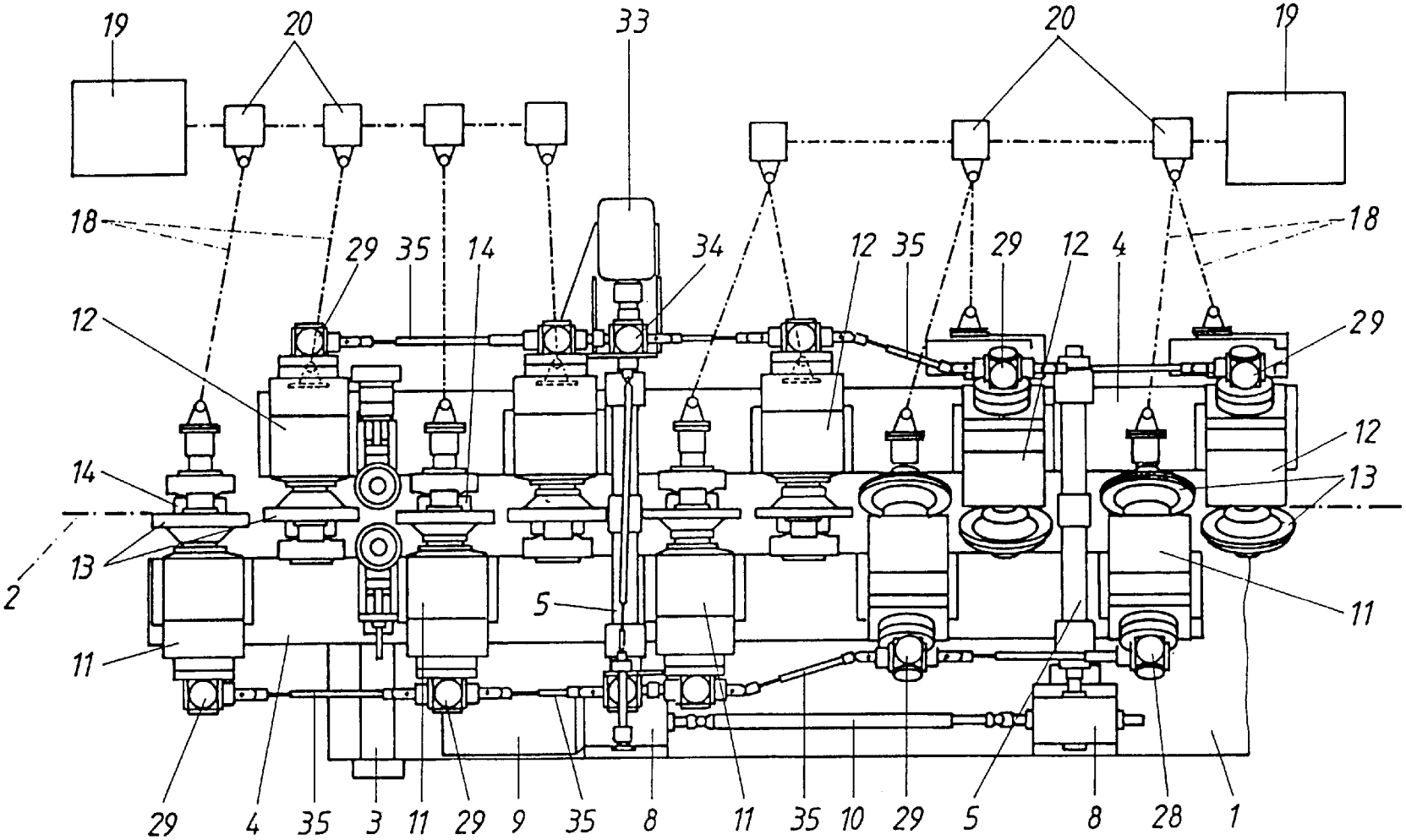
Figure 3:
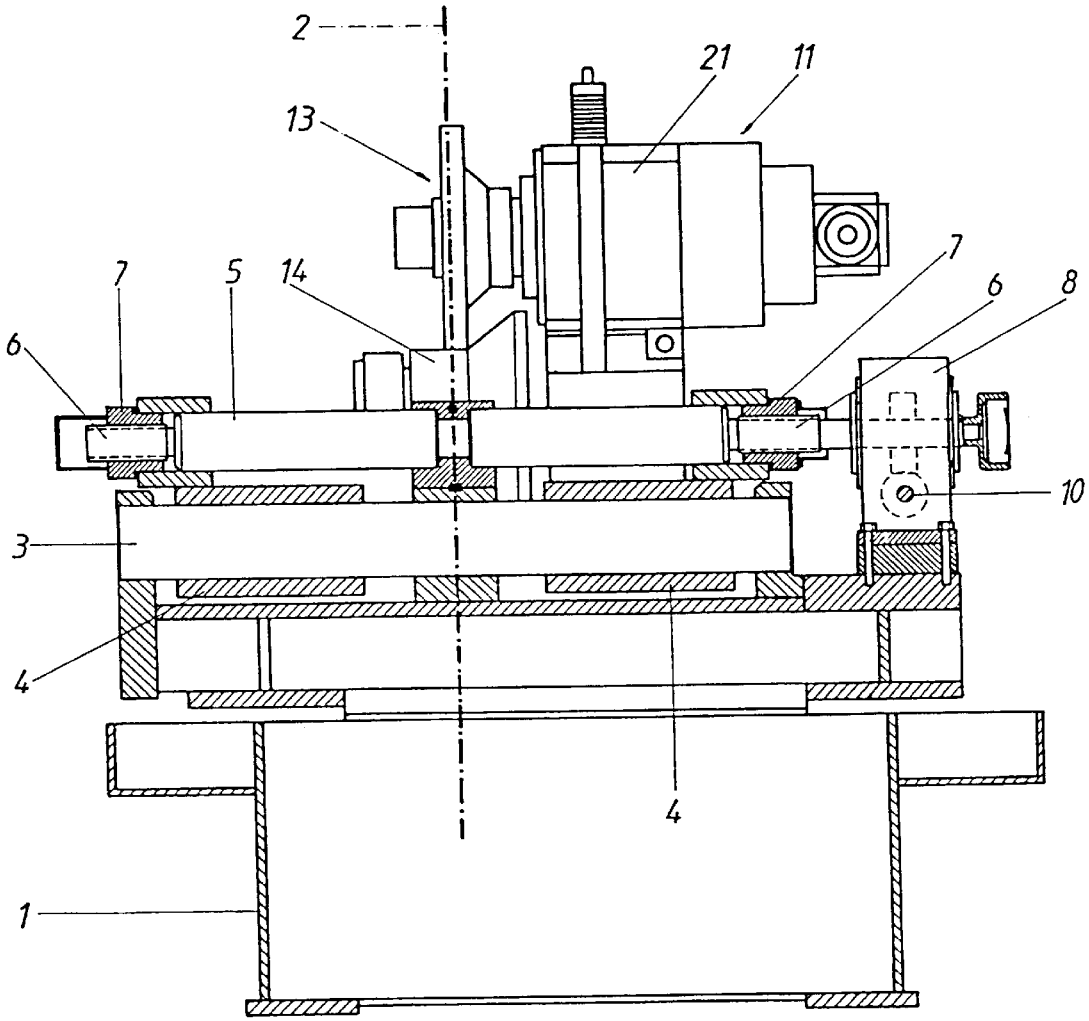
Figure 4:
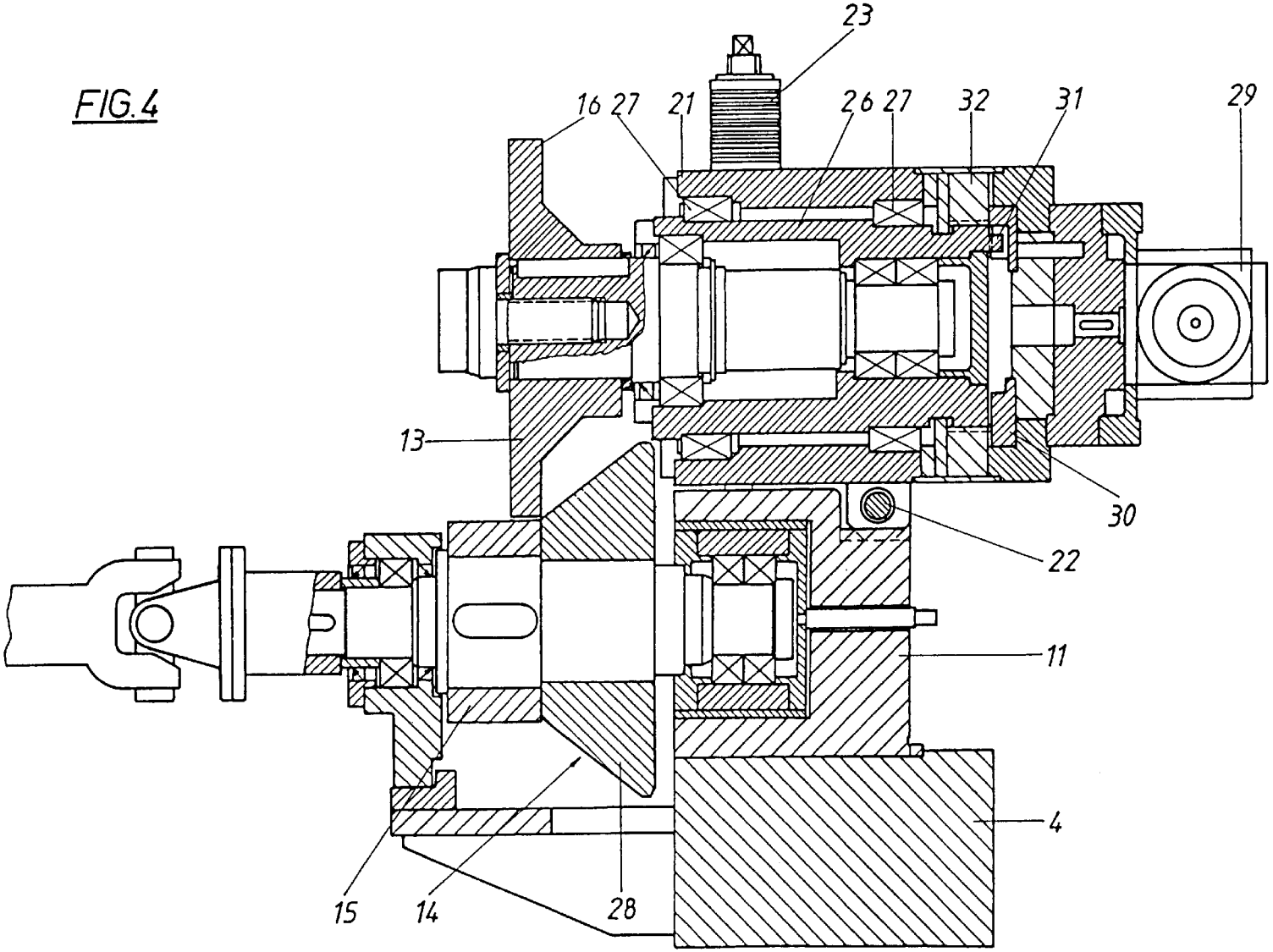
Figure 5:
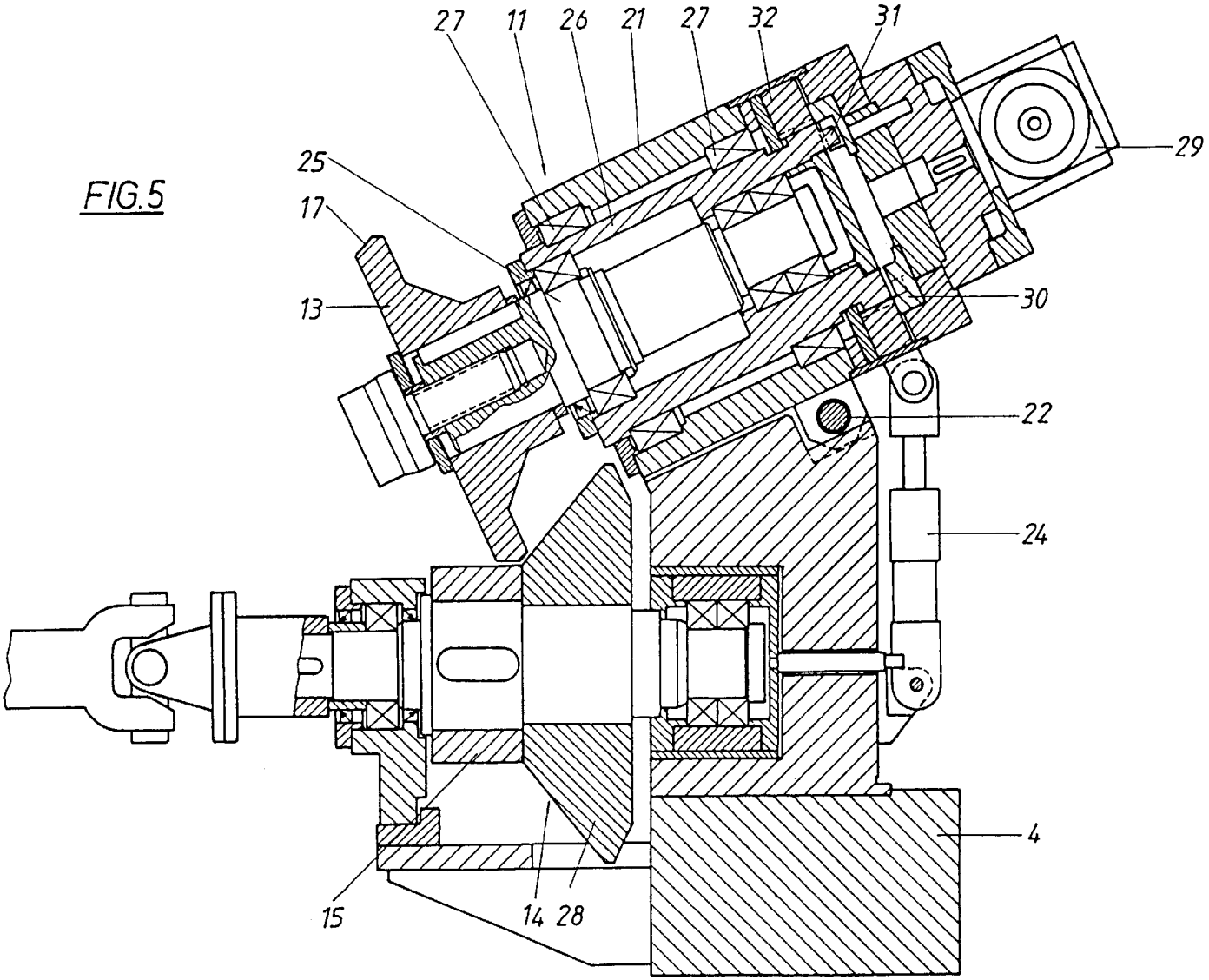
Figure 6:
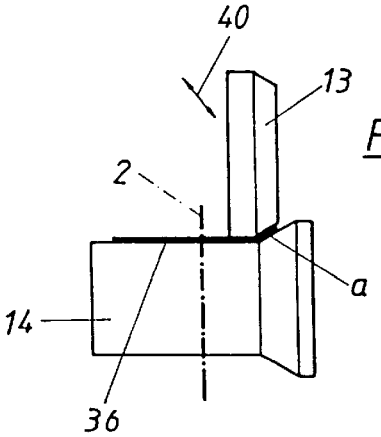
Figure 7:
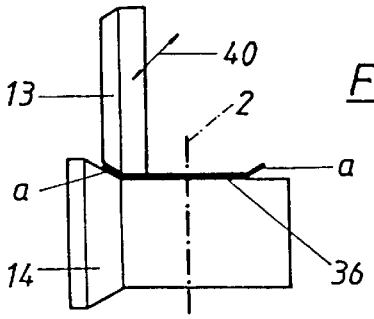

The subject matter of the invention is represented by way of example in the drawing, in which:

FIG. 1 shows the device according to the invention for continuously rolling a sheet-metal strip into a profile having a profile limb of straight cross section, in a diagrammatic side view, FIG. 2 shows a section of this device in a diagrammatic top view, FIG. 3 shows a section along the line III—III in FIG. 1, on an enlarged scale, FIG. 4 shows an axial section through a former roll with the associated counter-roll, on an enlarged scale, FIG. 5 shows a representation, corresponding to FIG. 4, of a former roll arranged inclined with respect to the counter-roll, and FIGS. 6 to 12 show steps in bending up the edge of a sheet-metal strip into a square section tube with the aid of the former and counter-rolls, used in accordance with the invention, in the region of individual former and counter-rolls, in diagrammatic cross sections.

In accordance with the exemplary embodiment represented, the device for continuously rolling a sheet-metal strip has a carrying substructure 1 having transverse guides 3 which are aligned perpendicular to a central plane 2 running in the longitudinal direction of the strip and on which carriers 4 are mounted which can be displaced in the opposite sense relative to the central plane 2. These carriers 4 are driven by threaded spindles 5 which are connected to threaded sections 6 of opposite sense, as is indicated in more detail in FIG. 3. Via threaded nuts 7 cooperating with the threaded sections 6, the carriers 4 are adjusted symmetrically with respect to the central plane 2 when the threaded spindles are driven via a drive shaft 10 by a common electric motor 9 by means of worm drives 8.

Frames 11, 12 with former rolls 13 and counter-rolls 14 are arranged on the carriers 4 in order to bend up in steps into a section tube of square cross section the edges of the sheet-metal strip to be deformed, doing so with the former and counter-rolls 13, 14 of the frames 11 on one side of the central plane 2, and with the former and counter-rolls 13, 14 of the frames 12 on the other side of the central plane 2. This bending operation is not, however, performed symmetrically with respect to the central plane 2, because the frames 11 on one side of the central plane 2 are arranged offset from one another in the longitudinal direction of the strip with respect to the frames 12 on the other side of the central plane 2, as is to be seen, in particular, from FIGS. 1 and 2. It is possible by means of these measures for the cylindrical section 15 of the counter-rolls 14 to have an axial width which is greater than the width of the flat sheet-metal band resting on this cylindrical section 15. The sections 16, which are cylindrical in the case of axially parallel former and counter-rolls 13, 14, of the former rolls 13 can have an axial width corresponding to the width of the sheet-metal band, resting on the cylindrical part 15 of the counter-rolls 14, for the smallest profile which can have its edges bent up by the device, thus resulting in advantageous rolling conditions for the deformation of the two sides of the sheet-metal strip. It is only when because of edge webs which have already had their edges bent up, the former rolls 13 have to be arranged inclined at an acute angle with respect to their counter-rolls 14 that it is necessary for the former roll section 17, which is then conical and cooperates with the cylindrical section 15 of the counter-roll 14, to be of correspondingly narrower design, as is shown in FIG. 5.

Whereas the former rolls 13 are mounted in their frames 11 and 12, respectively, such that they can rotate freely, the associated counter-rolls 14 are driven via telescopic universal joint shafts 18, specifically at least in groups via a common electric motor 19 which is connected in terms of drive to the universal joint shafts 18 via right-angle drives 20, as can be gathered from the diagram of FIG. 2.

In accordance with FIG. 4, the former rolls 13, which are axially parallel to their counter-rollers 14, are mounted in a frame part 21 which is pivoted about an axis 22, perpendicular to the common plane of the axes of the former and counter-rolls 13, 14, on the base frame 11 or 12. Since the frame part 21 is held via springs 23 in a working position limited by stops, the former roll 13 can be swivelled away from the counter-roll 14 against the spring force, and this provides an effective overload protection of the former and counter-rolls 13, 14. According to FIG. 5, it is necessary for the frame part 21 to be swivelled up in order to assemble the former and/or counter-rolls 13, 14. The frame part 21 is connected for this purpose to the base frame 11 or 12 via a swivelling cylinder 24.

The axle 25 of the former rolls 13 is mounted eccentrically in a bearing sleeve 26 which is held in the frame part 21 via bearings 27 and can be rotationally adjusted. If the bearing sleeve 26 is rotated with respect to the frame part 21, the eccentric retention of the former roll 13 in the bearing sleeve 26 causes an adjustment in the height of the former roll 13. However, the rotational adjustment of the bearing sleeve 26 also entails its adjustment by screws in order, in addition, to ensure axial displacement of the former roll 13, as well. This additional axial displacement is required in order to displace the former roll in the direction of the line of symmetry of the bending angle, so that the thickness of the roll gap is varied uniformly between the former roll 13 and the associated counter-roll 14 both in the cylindrical region 15 and in the conical section 28 of the counter-roll 14. The bearing sleeve 26 is adjusted by screws via a right-angle gear 29 with the aid of which a claw wheel 30 is driven which meshes with mating claws 31 of the bearing sleeves 26. Since the bearing sleeve 26 engages by means of a threaded section in a threaded nut 32 associated with the bearing part 21, when the bearing sleeve 26 is rotated via the right-angle gear 29 an adjustment by screwing is forced with respect to the threaded nut 32, specifically as a function of the screw pitch, which can be designed such that the desired movement of the former roll in the direction of the line of symmetry of the bending angle is set as a function of the eccentricity of the bearing of the former roll.

As may be seen from FIG. 5, the former rolls 13 and the counter-rolls 14 can be arranged inclined to one another at an acute angle, in order to be able more effectively to turn up the edges of an already angular edge web of the sheet-metal band, something which in some circumstances requires the angular edge web to be gripped from behind. Since, in general, the axle 25 of the former roll 13 is not perpendicular to the line of symmetry of the bending angle in such a case, a combined displacement of the axle 25 of the former roll 13 in transverse and longitudinal directions is required, in turn, in order to be able to adapt the roll gap between the former roll 13 and the counter-roll 14 to the thickness of the sheet-metal strip respectively being used.

Since the roll gaps of all the former and counter-rolls 13, 14 must be matched to the respective sheet-metal thickness, a common actuator can be provided for adjusting the former rolls 13 with respect to the counter-rolls 14. In accordance with FIG. 2, this actuator is formed from a positioning motor 33 which, in terms of drive, is connected via a distributor gear 34 and telescopic universal joint shafts 35 to the right-angled drives 29 for adjusting the bearing sleeves 26. Consequently, the device can be set in a simple way via the positioning motor 33 in accordance with the thickness of the sheet-metal strip used.

Figure 8:
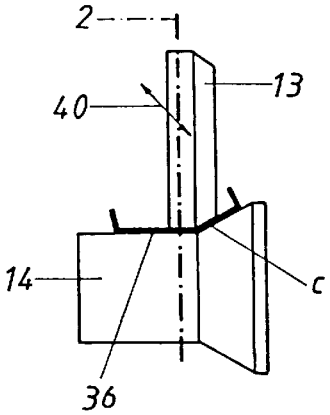
Figure 9:
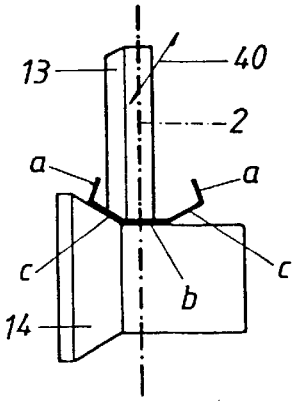
Figure 10:
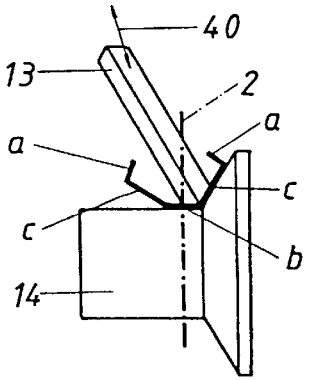
Figure 11:
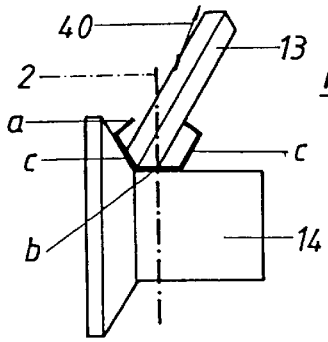
Figure 12:
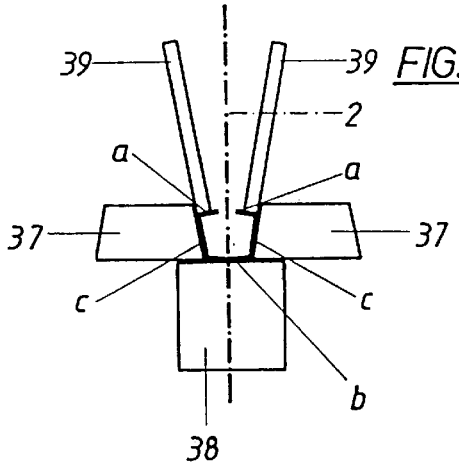

The mode of operation of the device according to the invention can be explained in more detail with the aid of FIGS. 6 to 12. In order to be able to roll a hollow profile of square cross section from a flat sheet-metal band 36 which, in accordance with FIG. 12, has two edge webs a which are to be welded along their abutting edges, are situated opposite a wall b formed from the central band of the sheet-metal strip and are supported by side walls c, the sheet-metal strip 36, which is orientated in the usual way, is bent up in steps, specifically with the aid of the former and counter-rolls 13, 14 provided alternately on two sides of the central plane 2. Consequently, the first step is for the edge web a to be incipiently bent on one side of the central plane 2 in accordance with FIG. 6, and then to be incipiently bent on the other side in accordance with FIG. 7, after which its edges are bent up in at least one further deforming stage until the side walls c are bent up in a similar way, as is indicated in FIGS. 8 and 9. The representations in FIGS. 8 and 9 show that the bending angle which can be achieved for the side walls c with mutually parallel former and counter-rolls 13, 14 is limited, with the result that in order to achieve larger bending angles the former rolls 13 are inclined with respect to the counter-rolls 14, as may be gathered from FIGS. 10 and 11. Since, even in the case of inclined former rolls 13, the required bending angle cannot be achieved for the side walls c, the edges of the later side walls c of the section tube to be formed are bent up in further deforming stages, as is indicated in FIG. 12. Symmetrical deformation is possible, since the profile limbs a, b and c are gripped only from outside via former rolls 37 for this final forming of the hollow profile, the hollow profile being held between a cylindrical counter-roll 38 and two support rolls 39 acting on the edge webs a. The hollow profile rolled in the way described from a flat sheet-metal strip 36 can then be fed to a welding machine in order to weld the edge webs a by butt welding.

In order to be able to use the device for rolling square section tubes with changed dimensions, it is necessary for the spacings of the former and counter-rolls 13, 14 from the central plane 2 to be set appropriately. For this purpose, the carriers 4 are correspondingly adjusted via the drive motor 9 to the effect that the frames 11 and 12 holding the former and counter-rolls 13, 14 are displaced on the mutually opposite sides of the central plane 2. Because of the different positioning paths of the frames 11, 12 which are required for bending up the edge webs a and the side walls c, the carriers 4 are correspondingly subdivided, with the result that the frames 11, 12 are displaced in groups in accordance with the respective requirements. Since these different positioning paths bear a constant ratio to one another for a prescribed profile shape, these different positioning paths can be taken into account via appropriate transformation ratios in the region of the worm gears 8 if no special drives 9 are provided for each group of carriers.

If, in addition, the thickness of the strip is changed, the former rolls 13 are to be displaced with respect to the counter-rolls 14 in the direction of the line of symmetry of the angle between the profile limbs which are bent towards one another. The arrows 40 in FIGS. 6 to 11 indicate this adjusting movement, which is caused by the positioning motor 33.

It is relatively easy for the rolling device in accordance with FIG. 12 to be adapted to different dimensions of the hollow profile to be formed, because in the case of a change to the width of the profile all that is required is to adjust the former rolls 37 for the side walls c in the opposite sense together with the support rolls 39 for the edge webs a. In the case of a change to the profile height, that is to say the width of the side walls c, all that is required is to set the support rolls 39 in the direction of the width of the side walls c.

Although the device according to the invention has been explained in conjunction with an exemplary embodiment for rolling square section tubes, it is, of course, not restricted to the production of such square section tubes, but can be used wherever profiles with limbs of straight cross section are to be bent up from a flat sheet-metal strip by a rolling operation.

What is claimed is:

1. A device for continuously rolling a sheet-metal strip into a profile with profile limbs of straight cross-section, the device comprising:

a plurality of roll assemblies, each of the roll assemblies comprising a forming roll, an opposed counter-roll, a supporting frame for the forming roll and the counter-roll, a bearing sleeve rotatably mounted in the frame, and a support axle for the forming roll eccentrically mounted in the bearing sleeve, the axle and the forming roll being moveable both axially and radially relative to the associated counter-roll upon rotation of the bearing sleeve;

a plurality of roll assembly carriers arranged in pairs on opposite sides of a central plane which runs longitudinally in the direction of motion of the strip, with at least two of the roll assemblies mounted on each of the carriers in longitudinally spaced relationship relative to the direction of motion of the strip; the respective carriers of each of the carrier pairs being arranged in generally opposed relationship across the central plane, and being concurrently movable in opposite directions along a line perpendicular to the central plane; the respective roll assemblies on one of the paired carriers being offset longitudinally in the direction of motion of the strip from the roll assemblies on the other one of the paired carriers.

2. A device as described in claim 1 further including a common drive mechanism connected to the sleeve bearings of all of the roll assemblies for simultaneously rotating the sleeve bearings.

3. A device as described in claim 1 further including a common drive mechanism connected to all of the roll assembly carriers for simultaneously moving the carriers perpendicular to the central plane.

4. A device as described in claim 3 further including a common drive mechanism connected to the sleeve bearings of all of the roll assemblies for simultaneously rotating the bearings.

5. A device as described in claim 1 further including a screw mechanism rotatably coupled to each of the bearing sleeves.

6. A device as described in claim 1 further including a pivot assembly having a pivot axis running longitudinally relative to the direction of motion of the strip on which each bearing sleeve is mounted.

7. A device as described in claim 6 in which each roll assembly further includes a spring for biasing the forming roll into a working position, the pivot assembly being rotatable to swivel the forming roll out of the working position against the force of the spring.

* * * * *